US005511776A

United States Patent [19]

Huru

[11] Patent Number: 5,511,776

[45] Date of Patent: Apr. 30, 1996

[54] ROLLER HOCKEY STICK BLADE

[75] Inventor: Mark W. Huru, Hancock, Mich.

[73] Assignee: Christian Brothers, Inc., Warroad, Minn.

[21] Appl. No.: 402,396

[22] Filed: Mar. 10, 1995

Related U.S. Application Data

[63] Continuation of Ser. No. 209,841, Mar. 11, 1994, abandoned.

[51] Int. Cl.[6] ..... A63B 59/12

[52] U.S. Cl. ..... 273/67 A

[58] Field of Search ..... 273/67 R, 67 A

[56] References Cited

U.S. PATENT DOCUMENTS

| | | | |
|---|---|---|---|
| D. 237,636 | 11/1975 | Leclerc . | |
| D. 325,412 | 4/1992 | Dauguard . | |
| 3,638,942 | 2/1972 | Bassett | 273/67 A |
| 4,076,240 | 2/1978 | Haddad | 273/67 A |
| 4,340,224 | 7/1982 | Staats | 273/67 A |
| 4,491,320 | 1/1985 | Smith . | |
| 4,563,006 | 1/1986 | Hollner | 273/67 A |

*Primary Examiner*—Raleigh W. Chiu
*Attorney, Agent, or Firm*—Dorsey & Whitney

[57] ABSTRACT

A roller hockey stick which is adapted for use with a standard roller hockey ball or the like is provided. The roller hockey stick includes a handle and a blade. The blade includes a heel end, toe end, a bottom edge, a top edge and an elongated opening or slot. The elongated opening is positioned between the top and bottom edges and extends from a point adjacent or near the heel end to a point adjacent or near the toe end.

20 Claims, 2 Drawing Sheets

ROLLER HOCKEY STICK BLADE

This is a continuation of application Ser. No. 08/209,841 filed Mar. 11, 1994 abandoned.

BACKGROUND OF THE INVENTION

1. Field of the Invention

The present invention relates generally to the field of hockey sticks and the like, and more particularly to a blade adapted for use with balls instead of hockey pucks.

2. Description of the Prior Art

With the advent of in-line skates, roller hockey has become increasingly popular. With the exception of the in-line skates and a ball, players often use ice hockey equipment, including ice hockey sticks, when playing roller hockey.

Hockey sticks in general, and ice hockey sticks in particular, have experienced dramatic changes throughout the years. As a result, ice hockey sticks have changed from a plain wooden stick having a solid, straight blade to a significantly improved stick that may include a metallic or composite handle coupled to a curved wooden blade that is reinforced with fiberglass or the like.

Other changes include constructing the hockey stick blade out of nontraditional materials such as plastics. U.S. Pat. No. 4,076,240 discloses a hockey stick including a blade having a plurality of interconnected plates made of plastic or composite molding materials. The plates form a network of open cells or apertures through the blade. U.S. Pat. No. 237,636 also discloses a hockey stick having a blade with apertures through the blade. U.S. Pat. No. Des. 325,412 discloses a hockey stick having a blade with an undulated bottom edge. The undulation forming voids that extend upwardly into the body of the blade.

U.S. Pat. No. 4,491,320 discloses a hockey practice device that includes a hockey stick and a puck substitute. The hockey stick blade has a slot along its base and the puck substitute has a groove in the upper surface for receiving the base of the hockey stick blade. The puck substitute is slidably connected to the blade, when the base of the blade is resting in the groove of the puck substitute, by a pin that is attached to puck substitute and that passes through the slot.

While the above-mentioned improved hockey sticks and the above-cited patents show improvements and advances in hockey sticks, these hockey sticks are not well suited for roller hockey where a spherical object is used instead of a puck. One problem is that hockey players prefer to manipulate the hockey stick when catching a pass so that the face of the blade receiving the puck forms an acute angle to the ice. The blade's angle to the ice enables a player to trap the puck between the top portion of the blade and the ice surface. Because of the higher profile dimension of roller hockey balls, the height of hockey stick blades and the relatively flat surfaces of known hockey blades, roller hockey balls are difficult to "trap" or catch with conventional hockey sticks.

Another related problem pertains to shooting a roller hockey ball. Similar to catching a puck, hockey players begin many of their shots by using the ice and the top portion of the blade to trap or cup the puck against the ice surface. As they bring the puck forward the blade of the stick rotates along its horizontal axis causing the blade to be generally perpendicular to the ice surface. The shot is completed by a quick rotation along the blades vertical axis causing the tip of the blade to rapidly accelerate towards the target. Because a roller hockey ball does not trap as readily as a puck, if at all, when using an ice hockey stick, control of a ball is difficult to achieve. Furthermore, because the roller balls are less dense and have less surface area in contact with the ice, they tend to bounce or ride up on the surface of the blade when the blade opens up, or become perpendicular to ice, during the shot making it difficult for the player to shoot a roller hockey ball accurately with an ice hockey stick as compared to a puck.

Another problem is that ice hockey stick blades tend to ride up and over roller hockey balls. As the user exerts pressure on a rolling ball with a flat solid blade, the surface of the blade grips the ball causing it to follow the balls rolling motion.

Still another problem is that solid hockey stick blades may create unwanted air resistance. This air resistance may have more impact on roller hockey balls that are considerably less dense than ice hockey pucks.

Yet another problem is that larger hockey blades equate to increased weight and correspondingly to increased wrist and forearm fatigue.

Accordingly, a need exists in the art for a roller hockey stick comprising a blade which is light weight while providing acceptable strength, which provides the desired characteristics for maximum control of a spherical object, like roller hockey balls, which meets acceptable safety standards and which is also cost effective.

SUMMARY OF THE INVENTION

The present invention relates to a roller hockey stick which is adapted for use with standard roller hockey ball or the like. More specifically, the roller hockey stick of the present invention includes a handle and a blade. The blade includes a heel end, toe end, a bottom edge, a top edge and an elongated opening or slot. The elongated opening is positioned between the top and bottom edges and extends from a point adjacent or near the heel end to a point adjacent or near the toe end. The blade can be of integral construction with the handle or the blade can be replaceably coupled to the hollow end of a hockey stick handle.

Accordingly, it is an object of the present invention to provide a hockey stick that better accommodates balls used for roller hockey.

Related objects of the present invention are to provide a blade for a hockey stick that improves the user's ability to catch passes and shoot the ball.

Another object of the present invention is to provide a blade for a hockey stick that has a ball receiving area to prevent the blade riding up and over a rolling ball.

Still another object of the present invention is to provide a blade for a hockey stick that is light weight, but which embodies sufficient strength to resist stresses.

Yet another object of the present invention is to provide a hockey stick blade that reduces air resistance.

These and other objects of the present invention will become apparent with reference to the drawings, the description of the preferred embodiment and appended claims.

DETAILED DESCRIPTION OF THE PREFERRED EMBODIMENT

Figure 1:
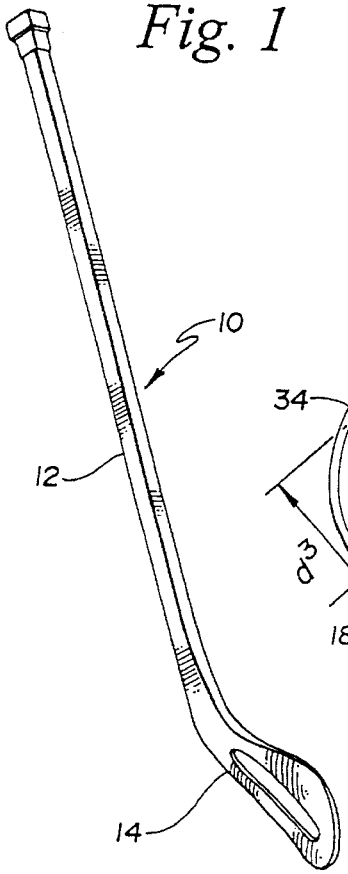
FIG. 1 is a perspective view of a hockey stick incorporating the improvements of the present invention.
Figure 8:
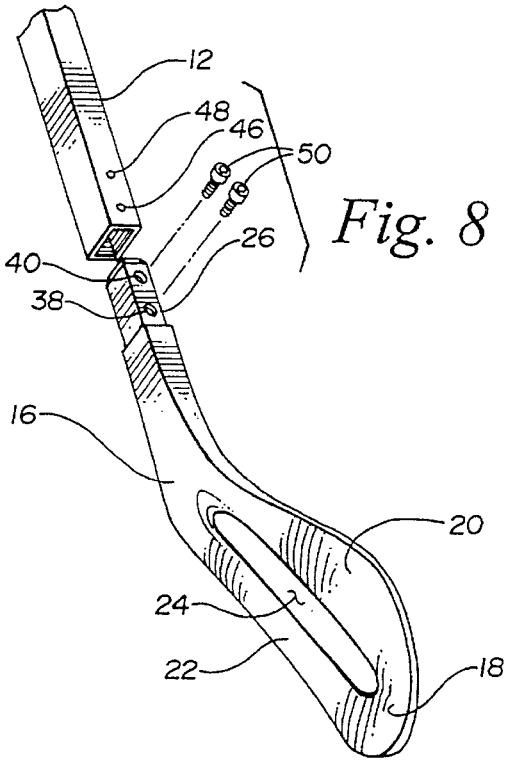
FIG. 8 is perspective, partially broken apart view of a hockey in assembled form incorporating the improvements of the present invention.

Reference is first made to FIGS. 1 and 8 showing a hockey stick embodying the present invention. Specifically, FIG. 1 shows a hockey stick having an integral handle and blade, and FIG. 8 shows a hockey stick having a hollow open end for connection with a replaceable blade embodying the present invention. The roller hockey stick 10 broadly includes a handle 12 and a blade 14. As seen in FIG. 8, the blade 14 of the present invention may be made to be fitted to hockey sticks handles commercially available for use with replacement hockey blades.

Figure 2:
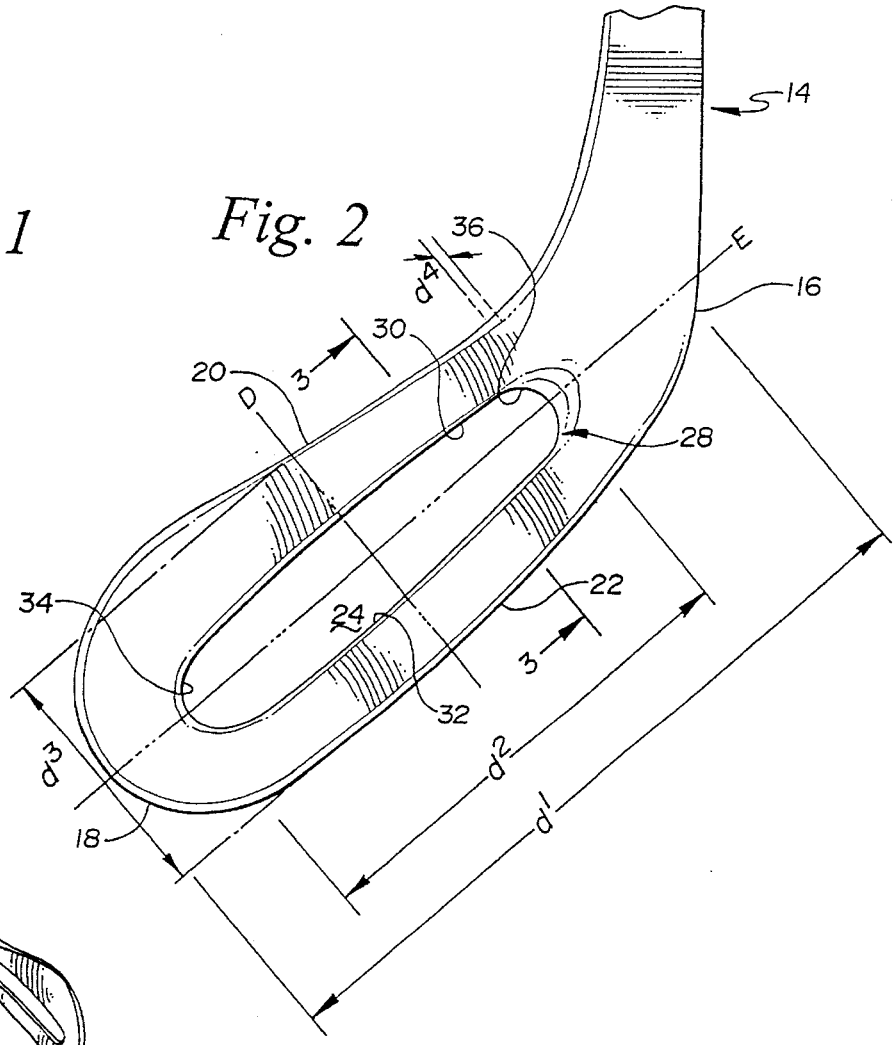
FIG. 2 is a side view of a hockey stick blade incorporating the improvements of the present invention.

As depicted in FIG. 2, the blade 14 includes a heel end 16, a toe end 18, a top edge 20, a bottom edge 22, and a single elongated opening or slot 24. A shaft connecting portion or end 26 is integrally formed at the heel end 16 of the blade 14. The elongated slot 24 is positioned between the top edge 20 and the bottom edge 22 and extends from a point adjacent or near the toe end 18 to a point adjacent or near the heel end 16. The elongated slot 24 is defined by an opening edge 28 comprised of a top opening edge 30, a bottom opening edge 32 and a pair of end edges 34, 36.

Figure 3:
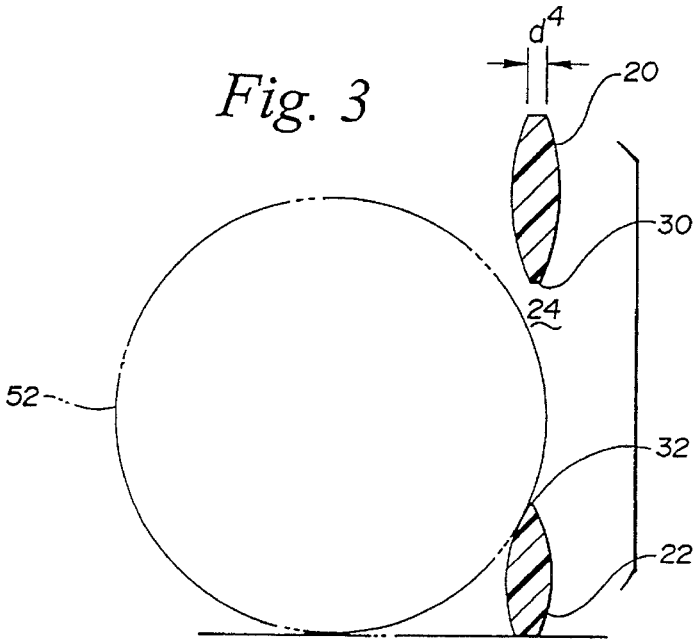
FIG. 3 is a sectional view as viewed along the section line 3—3 of FIG. 2 depicting a ball contacting a face of the blade.

With continued reference to FIG. 2, the height of the blade 14 is greater at the toe end 18 than at the heel end 16. The difference in height is attributable to a gradual increase in the height of the top edge 20 of the blade 14 near the toe end 18. Preferably the top opening edge 30 is straight or has a slight convex curve relative to the elongated slot 24. Preferably the bottom opening edge 32 is also straight or has a slight convex curve relative to the elongated slot 24. Preferably the distance between the top opening edge 30 and the bottom opening edge 32 throughout a substantial length of the elongated slot 24 does not vary by more than 20 percent. In either case, the top opening edge 30 and the bottom opening edge 32 are substantially straight. This results in an opening 24 in which the top edge 20 and the bottom edge 22 are substantially equally spaced from each other throughout a substantial distance of the opening 24. As depicted in FIG. 3, the top opening edge 30 and the bottom opening edge 32 are beveled. The end edges 34, 36, may also be similarly beveled.

Figure 6:
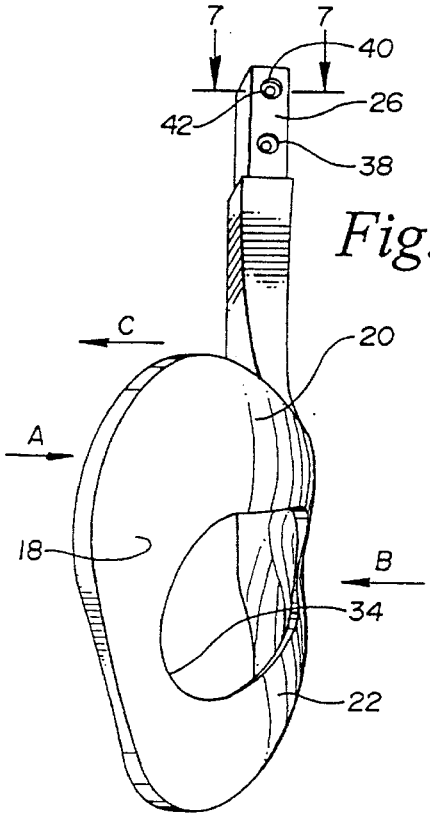
FIG. 6 is a top view of a replaceable hockey stick blade incorporating the improvements of the present invention.

As illustrated in FIG. 6, the blade 14 preferably curves to provide a convex face and concave face, A and B, respectively. In addition, the curvature of the bottom edge 22 is less than the curvature of the top edge 20 thereby providing the blade 14 with slight torsion. The torsion provides a slight curve at the top edge 20 near the toe end 18 of the blade 14 in the direction of Arrow C.

Also depicted in FIG. 6, is the shaft connecting end 26 that is an integral extension of the heel end 16. In this embodiment, the blade 14 is a replacement blade to be used interchangeably with specially made hockey stick handles such as the handle 12 depicted in FIG. 8.

Figure 7:
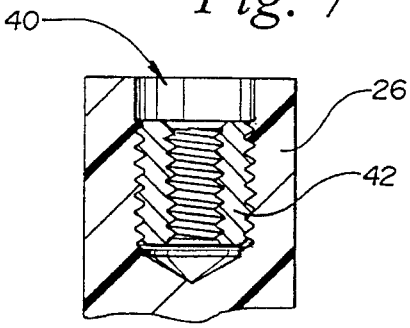
FIG. 7 is a sectional view as viewed along the section line 6—6 of FIG. 5.

The shaft connecting end 26 is rectangular in shape and of solid construction. The end 26 includes two threaded holes 38, 40, respectively, for receiving bushings 42 threaded externally and internally. As seen in FIG. 7, the bushing 42 is recessed into the hole 40. Although the preferred embodiment shows bushings threaded externally and internally, other connection means are possible. For example, the bushings can be threaded only internally and wedged or bonded to the connection end. Further, although the preferred embodiment incorporates mechanical fasteners, the shaft connecting end 26 could be constructed without threaded bushings as shown, but connected with use of adhesive or other known connecting means.

Figure 5:
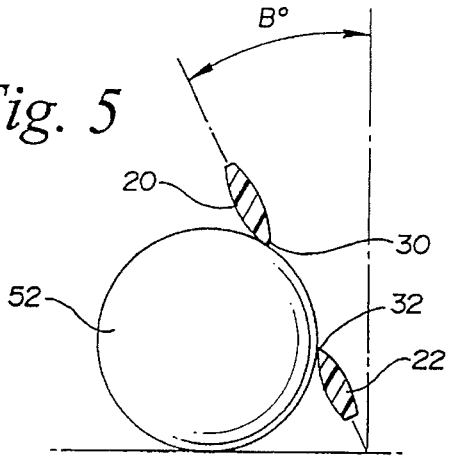
FIG. 5 is a sectional view similar to FIG. 4, but with the blade canted towards the ball at angle B.

FIG. 8 depicts the blade 14 shown in FIG. 5 next to a handle 12 having one end 44 adapted for receiving a blade 14. Such end 44 includes two apertures 46, 48, respectively. The heads of screws 50, fit flush within apertures 46, 48, respectively when secured within the bushings 42.

The blade 14 can be used with any spherical object, but the preferred object is a roller hockey ball 52. Referring to FIG. 3, the ball 52 has a diameter of approximately 2½ to 2¾ inches. As seen in FIG. 3, the ball 52 has one point of contact when the plane of the blade 14 is perpendicular, or substantially perpendicular to the playing surface. Such point of contact is along the beveled bottom opening edge 32. The elongated slot 24 allows the circumference of the ball to penetrate the plane of the blade 14 and to fully contact the beveled portion of the bottom edge 22.

Figure 4:
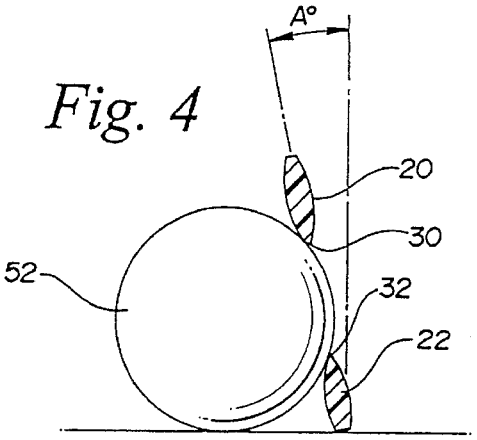
FIG. 4 is a sectional view similar to FIG. 3, but with the blade canted towards the ball at angle A.

As shown in FIG. 4, the elongated slot provides for two points of contact with the ball 52 when the blade 14 is canted towards the ball 52. Even when the blade 14 is angled to the point where the bottom edge 22 is lifted off the playing surface because the blade 14 is being supported by the ball 52, as depicted in FIG. 5, the user's pressure on the hockey stick 10 keeps the ball 52 trapped between the beveled top opening and bottom opening edges 30, 32, respectively, of the blade 14 and the playing surface. Contact at two points on the ball 52, or the cupping of the ball 52 by bottom edge 22 and the top edge 20, enables the user to achieve maximum control of the ball 52 on both the blade's 14 forehand and backhand sides.

When shooting the ball 52 the increased surface area of the top edge 20 adjacent the toe end 18 provides the user with a sufficient surface area and rigidity to prevent the ball 52 from losing energy when projecting the ball 52 towards the target. The increased surface area and slight curve (depicted by Arrow C) adjacent the toe end 18 also assists the user when catching passes.

The blade 14 of the present invention can be 8 to 12 inches long from the heel end 16 to the toe end 18 and ⅛ to ⅜ inches thick, preferably about 10¾ inches long from the heel end 16 to the toe end 18, as depicted by distance $d^1$ in FIG. 2, and approximately ¼ inch thick, as depicted by distance $d^4$. The slot 24 should be as long as possible to maximize the area that can be used to cup the ball 52 with the blade 14 while still providing a durable and long lasting blade 14. Typically the slot 24 will be about 50 to 85 percent as long as the blade 14. The slot 24 of the preferred embodiment is 6¾ inches long, as depicted by distance $d^2$. The height of the blade 14, as depicted by distance $d^3$, is 3½ inches at Centerline D. The slot 24 is approximately equally spaced between the top and bottom edges 20, 22, respectively, of the blade.

When the present invention is embodied in a blade 14, as depicted in FIGS. 6 and 8, the blade 14 is attached by inserting the connecting end 26 into the end 44 of the handle 12 adapted for receiving replacement blades. When the connecting end 26 is fully inserted, holes 38, 40 of the blade 14 will line up with apertures 46, 48, respectively. The screws 50 are then inserted and tightened until the heads of the screws 50 are flush with the outer side of the handle 12. Removal of a blade 14 is accomplished by reversing the procedure for attaching a blade 14. If an adhesive is used, the application of heat may be used to remove the blade 14.

Plastic is the preferred material for forming the blade 14 and aluminum is the preferred material for forming the handle 12 of the present invention, but any suitable material, e.g. composite materials or wood can be used. Further, the entire stick 10 can be constructed of plastic.

Although a description of the preferred embodiment has been presented, it is contemplated that various changes, including those mentioned above, could be made without deviating from the spirit of the present invention. Accordingly, it is intended that the scope of the present invention be dictated by the appended claims rather than by the description for the preferred embodiment.

What is claimed is:

1. A ball hockey stick having a handle and a blade wherein said blade comprises a heel end, a toe end, a bottom edge, a top edge, and a ball receiving opening comprising an elongated opening positioned between said top and bottom edges and being elongated in the direction extending from said heel end to said toe end, said blade having a centerline axis extending the length of said blade midway between said top edge and said bottom edge, and a substantial portion of said elongated opening extending above said centerline axis.

2. The blade of claim 1 wherein said elongated opening extends from near said heel end to near said toe end.

3. The blade of claim 2 wherein said elongated opening is at least 50 percent as long as the blade.

4. The blade of claim 2 wherein said elongated opening is defined by an opening edge and said opening edge includes a pair of opposed top and bottom opening edges and opposed end opening edges.

5. The blade of claim 4 wherein the distance between said top and bottom opening edge is no greater adjacent said end opening edges than it is at a location generally equidistant between said end opening edges and the distance between said top opening edge and said bottom opening edge is greater than one inch.

6. The blade of claim 1 wherein said blade portion has a length and a height of at least three inches along a portion of said length.

7. A roller hockey blade comprising a heel end, a toe end, a bottom edge, a top edge, and a ball receiving opening defined by an opening edge wherein at least a portion of said opening edge is beveled.

8. The blade of claim 7 wherein said heel end includes a handle connection end.

9. The blade of claim 8 wherein said handle connection end includes a means for connecting said handle connection end to a hockey stick handle.

10. A ball hockey blade comprising a top edge, a bottom edge, a toe end, a heel end, a centerline axis extending the length of said blade midway between said top edge and said bottom edge; and a roller hockey ball receiving slot comprising an elongated opening positioned between said top and bottom edges and being defined by an opening edge provided in said blade portion, a substantial portion of said elongated opening extending above said centerline axis.

11. The blade of claim 10 having a length and a height of at least three inches along a portion of said length.

12. The blade of claim 10 being a replacement blade.

13. The blade of claim 12 being adapted for use with a handle.

14. The blade of claim 13 wherein said opening edge includes a pair of opposed top and bottom opening edges and opposed end opening edges and wherein said top opening and bottom opening edges are substantially equally spaced throughout the length of said elongated opening.

15. The blade of claim 14 wherein the distance between said top opening edge and said bottom opening edge is greater than one inch.

16. The blade of claim 15 wherein a portion of said opening edge is beveled.

17. The blade of claim 13 wherein the distance between said top and bottom opening edge is no greater adjacent said end opening edges than it is at a location generally equidistant between said end opening edges.

18. A ball hockey blade comprising:

top and bottom edges and toe and heel ends; and an elongated ball receiving slot positioned between said top and bottom edges and being elongated in the direction extending from said heel end to said toe end, a portion of said slot being at least one and three quarters (1¾) inches from said bottom edge.

19. The blade of claim 18 wherein said slot includes end edges and is at least one and three quarters (1¾) inches from said bottom edge midway between said end edges.

20. The blade of claim 19 wherein a substantial portion of said slot is at least one and three quarters (1¾) inches from said bottom edge.

* * * * *